United States Patent [19]

Fliege

[11] Patent Number: 4,562,711

[45] Date of Patent: Jan. 7, 1986

[54] MAGNETICALLY CODED LOCKING SYSTEM

[75] Inventor: Hans Fliege, Obertheres, Fed. Rep. of Germany

[73] Assignee: SACHS-Systemtechnik GmbH, Schweinfurt, Fed. Rep. of Germany

[21] Appl. No.: 611,415

[22] Filed: May 17, 1984

[30] Foreign Application Priority Data

May 21, 1983 [DE] Fed. Rep. of Germany ..... 3318624

[51] Int. Cl.[4] ..... E05B 47/00

[52] U.S. Cl. ..... 70/276; 70/413

[58] Field of Search ..... 70/276, 277, 278, 413; 235/382.5; 340/825.31, 825.3

[56] References Cited

U.S. PATENT DOCUMENTS

| | | | |
|---|---|---|---|
| 3,403,380 | 9/1968 | Welch | 235/382.5 |
| 3,821,704 | 6/1974 | Sabsay | 235/382.5 |
| 4,280,118 | 7/1981 | Bunker | 70/413 |
| 4,287,733 | 9/1981 | Gomez-Olea | 70/276 |
| 4,442,345 | 4/1984 | Mollier | 235/382.5 |
| 4,513,199 | 4/1985 | Sidline | 235/382.5 |

FOREIGN PATENT DOCUMENTS

| | | |
|---|---|---|
| 2753381 | 6/1979 | Fed. Rep. of Germany . |
| 2824684 | 12/1979 | Fed. Rep. of Germany . |
| 1456138 | 11/1976 | United Kingdom . |

*Primary Examiner*—Robert L. Wolfe

*Attorney, Agent, or Firm*—Toren, McGeady, Stanger, Goldberg & Kiel

[57] ABSTRACT

The locking system comprises a magnetic key having a plurality of parallel rows of magnets arranged in a pattern one behind the other and forming a locking code of the magnetic key, and a reading device into which the magnetic key can be inserted in the direction of the rows of its magnets. The reading device comprises magnetic field sensors for the serial reading of the locking code formed by the magnets. A control circuit which compares the information of the read locking code with the information of a predetermined locking code generates a control signal in dependence upon the conformity or difference of the locking codes. At least the magnets of the pattern positions of each row which are immediately adjacent in the row direction are oppositely polarized. For each row of magnets the reading device comprises two magnetic field sensors of which the first magnetic field sensor responds selectively to magnetic fields of a given polarity and the second magnetic field sensor responds selectively to magnetic fields with opposite polarity. The output signals of the magnetic field sensors are OR-linked with one another for the production of a clock signal. In order to prevent tampering in the insertion of the key into the reading device, the clock pulses are counted in the insertion of the key and compared with a predetermined number.

9 Claims, 5 Drawing Figures

MAGNETICALLY CODED LOCKING SYSTEM

BACKGROUND OF THE INVENTION

The invention relates to a magnetically coded locking system having a magnetic key and a reading device which serially reads the locking code of the magnetic key.

STATEMENT OF PRIOR ART

From Fed. German Publ. Spec. No. 2,753,381 a locking system is known comprising a magnetic key having a plurality of magnets which form a locking code of the key, and a reading device which reads the locking code of the key by means of magnetic field sensors. The magnets of the key are arranged displaceably in a pre-determined pattern. The reading device has magnetic field sensors for each of the possible pattern positions of the key and reads the locking code in parallel form. The reading device requires a large number of magnetic field sensors and is therefore relatively expensive.

In the locking system according to Fed. German Publ. Spec. No. 2,753,381 the key has a flat shape. Magnetic keys with cylindrical key body are known for example from Fed. German Publ. Spec. No. 2,824,684 and U.S. Pat. Nos. 4,317,156 and 4,392,134. The reading devices for these magnetic keys likewise read the information in parallel. An insertion indicator, for example a magnetic field sensor, sensing an additional magnet provided on the magnetic key detects the fully inserted position of the key and enables a control circuit which compares the locking code information of the magnetic key with a pre-determined locking code information to deliver a control signal in the case of conformity.

Finally, from British Pat. No. 1,456,138 a locking system is known in which information elements, for example holes or magnetic code dots, arranged in two rows on a key card are read serially by means of a reading device. The serially read locking code information is used to generate clock signals for shift registers or the like and is compared with a pre-determined locking code information. In the case of conformity of the read locking code information with the predetermined locking code information, a control signal is generated.

OBJECT OF THE INVENTION

It is an object of the invention, in a locking system comprising a serially readable magnetic key, to reduce the pattern interval of the magnets of the magnetic key, so that the dimensions of the magnetic key can be reduced and/or the number of locking code combinations of the magnetic key can be increased.

SUMMARY OF THE INVENTION

According to the invention the magnets which form the locking code of the magnetic key are arranged in a pattern lying one behind the other in several parallel rows. At least the magnets of the pattern positions of each row which are adjacent directly in the direction of the row are polarised in opposite directions. For each magnet row the reading device has two magnetic field sensors. One of these two magnetic field sensors responds selectively to magnetic fields of a predetermined polarity and the other magnetic field sensor responds selectively to magnetic fields of the opposite polarity. In this way adjacent magnets in the row direction can be arranged substantially closer side by side and nevertheless can be recognised and read as separate magnets.

This permits a reduction of the dimensions of the magnetic key and/or an increase of the number of possible locking code combinations. The control circuit is preferably a micro-processor. The magnetic field sensors are preferably formed as selective, digital Hall switches.

The pattern positions of all magnet rows of the magnetic key are arranged preferably transversely of the row direction in mutually parallel planes extending transversely of the row direction. In each plane there is situated at least one magnet, preferably two magnets lying in adjacent rows are provided. In each pattern plane there are arranged either exclusively magnets of the pre-determined polarity or exclusively magnets of the opposite polarity.

The above-explained manner of arrangement of the magnets permits deriving a timing or clock pulse signal from the magnets forming the locking code, for example by OR-linking of the output signals of the magnetic field sensors, so that no separate timing signal track or the like has to be provided on the key.

In locking system with serially read magnetic keys, one can attempt to simulate the correct locking code by suitable partial insertion and withdrawal of a magnetic key having a different locking code. In order to prevent manipulations of this kind it is preferably provided that the reading device comprises an insertion indicator which delivers an indicator signal when the magnetic key is inserted fully. The control circuit counts timing pulses and generates the control signal only if a pre-determined number of timing pulses has been counted by the time of occurrence of the indicator signal. In this case the control circuit can count the number of the timing pulses generated on insertion of the magnetic key until the arrival of the indication signal and compare it with the number of timing pulses generated in the subsequent withdrawal of the magnetic key from the reading device. The control signal is then generated in dependence upon the result of this comparison.

To increase the locking security of the locking system not only the locking code read in the insertion of the magnetic key but also the locking code read in the withdrawal of the magnetic key and then inverted in time can be compared with the pre-determined locking code of the locking system, for the generation of the control signal.

The locking system is used preferably in motor vehicles to control central locking installations and/or theft alarms. Especially for such purposes it is advantageous if the locking system requires only little working current as long as it does not have to read a locking code. In order to achieve this it is preferredly provided that the reading device is connected to a working current source through a switch controllable by the control circuit. A current-saving readiness mode of operation of the reading device can be achieved if the control circuit opens and closes the switch periodically and holds the switch constantly closed at least for the duration of the reading of the locking code information only upon the detection of the first magnet by the reading device in insertion of the magnetic key. This improvement, which is also usable with other serially reading locking systems, permits an extensive reduction of the electrical power consumption required in the readiness mode of operation of the reading device. The closure time interval of the switch can be extraordinarily short and is essentially limited only by the response time of the magnetic field sensors. The opening time interval of the switch is limited by the maximum speed at which the magnetic key can be introduced into the reading device. It must be ensured that for the duration of the time period at which the closure intervals of the switch succeed one another, at least the magnetic key magnet to be read first cannot be moved through the response region of the magnetic field sensor responding to this magnet. In order to prolong the response time at least for the first magnet, the first magnet can be made longer in the direction of insertion of the key. The control circuit can change over again into the current-saving readiness mode of operation immediately after conclusion of the reading operation. It can however also hold the switch closed for a pre-determined period after commencement of reading.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF PREFERRED EMBODIMENTS

Figure 1:
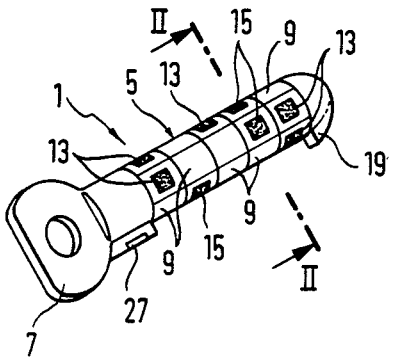
FIG. 1 shows a perspective view of a magnetic key.
Figure 3:
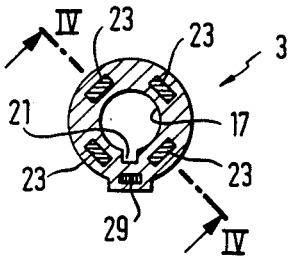
FIG. 3 shows a cross-section through a reading device for the magnetic key according to FIG. 1.
Figure 2:
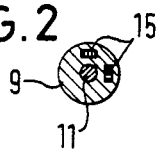
FIG. 2 shows an axial cross-section through the magnetic key, seen along a line II—II in FIG. 1.
Figure 4:
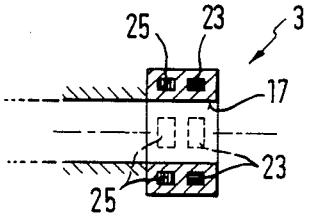
FIG. 4 shows an axial longitudinal section through the reading device, seen along a line IV—IV in FIG. 3.

FIGS. 1 and 2 show a magnetic key 1, the magnetic locking code information of which can be read serially by means of a reading device 3 represented in FIGS. 3 and 4. The magnetic key 1 comprises a substantially cylindrical elongated shank 5 provided with a handle 7 at its one end. The shank 5 is composed of a plurality of segments 9 arranged one beside the other in the axial direction, which are secured non-rotatably in relation to one another and to the handle 7, by means of a spindle 11 on the handle 7. Each of the segments 9 carries two permanent magnets 13 of a first flux direction or two permanent magnets 15 of the opposite flux direction, offset in the circumferential direction. The magnets 13, 15 of each segment 9 are arranged, as regards the maximum of their field strength, each in a plane perpendicular to the axis of the shank 5. The magnets 13, 15 are arranged in the circumferential direction in a pattern and form magnet rows extending in the axial direction of the shank 5. The magnets of adjacent segments 9 are polarised alternately. By way of example the magnets 13 have their south poles on the outside of the key while the magnets 15 have their north poles on the outside of the key. In this way the magnets can be arranged very closely adjacently in a pattern in the axial direction of the shank 5, without detriment to the legibility of the locking code information.

The reading device 3 comprises a key passage 17 into which the shank 5 of the magnetic key 1 can be inserted. On the end of the shank 5 remote from the handle 7 a guide nose 19 is provided which engages in a longitudinal groove 21 of the key passage 17 and guides the shank 5 non-rotatably in insertion and withdrawal. The reading device 3 comprises two sets of selective magnetic field sensors 23 and 25 which are arranged in the transverse pattern of the magnets 13, 15 and past which the magnets 13, 15 are moved both in the insertion and in the withdrawal of the magnetic key 1. The magnetic field sensors 23 on the one part and the magnetic field sensors 25 on the other are arranged in planes perpendicular to the axis of the key passage 17 and respond selectively to oppositely directed magnetic fields. By way of example the magnetic field sensors 23 arranged in one common plane respond selectively to the magnetic fields of the magnets 13 and the magnetic field sensors 25 respond selectively to the magnetic fields of the magnets 15 of the magnetic key 1. The planes of the magnets 23 and 25 are preferably arranged at a shorter interval than the axial interval of adjacent magnets 13, 15, so that the axially adjacent magnets 13, 15 can be read in succession. The magnetic field sensors 23, 25 are preferably digital Hall switches which respond either to north poles or to south poles of magnets.

In order to detect whether the magnetic key 1 has been pushed fully into the reading device 3, in the region of its handle 7 the magnetic key 1 carries an additional magnet 27 which is detected by an additional magnetic field sensor 29 of the reading device 3. In place of the magnetic field sensor 29 responding to the magnet 27 other insertion indicator means, for example mechanically actuated switch contacts or the like, can be provided. Likewise, the magnet 27 can be provided at another position, for example at the end of the shank 5 remote from the handle 7.

In the embodiment as illustrated each segment 9 of the magnetic key 1 has four pattern positions offset by 90° in relation to one another. Correspondingly, the reading device 3 comprises four magnetic field sensors 23 and four magnetic field sensors 25. Other configurations with more or even with less pattern positions per segment are conceivable. Finally it should be mentioned that the segments 9 can also be integrally connected with one another and that the magnets 13, 15 can also be formed by the magnetisation of a magnetic surface layer of the shank 5. The number of segments 9 can be considerably greater than as illustrated in FIG. 1. It can however also be less.

Figure 5:
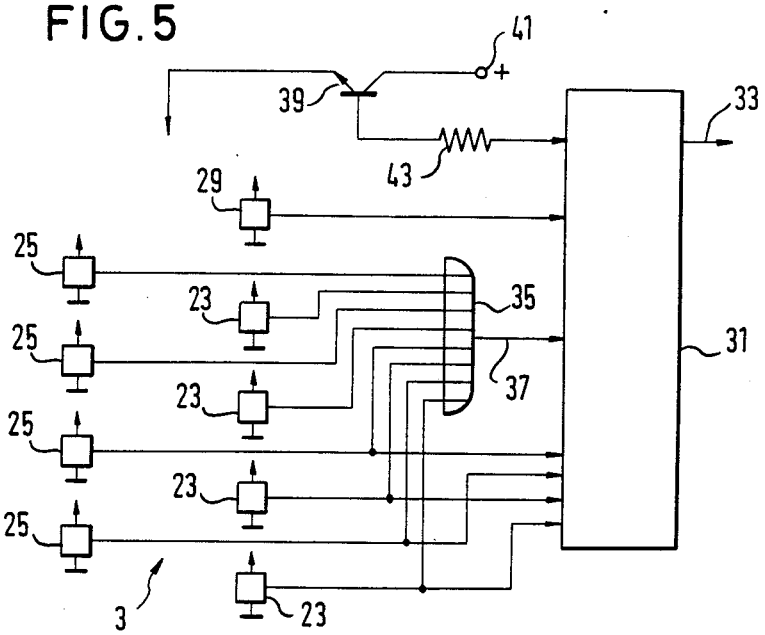
FIG. 5 shows a diagrammatic circuit diagram of the locking system.

FIG. 5 shows diagrammatically a circuit diagram of the locking system formed by the magnetic key 1 and the reading device 3. Elements conforming with FIGS. 1 to 4 are designated by the same numerals. The magnetic field sensors 23, 25 are connected with a control circuit 31 which compares the locking code, read serially in the insertion of the magnetic key 1 into the reading device 3, with a predetermined locking code allocated to the locking system, and generates a control signal at its output 33 if the compared locking codes are in conformity. The control signal can be utilised to actuate a locking apparatus, especially the central locking installation of a motor vehicle, or to trigger an alarm or the like. The control circuit 31 is preferably a microprocessor. In the embodiment as illustrated only two of the four magnetic field sensors of each set are connected to the control circuit since, as shown by the following logic value table, the information from two of the four magnetic field sensors of each set suffices to describe completely the information of each segment 9 of the magnetic key 1. In the logic value table the pattern positions are indicated by angles and the magnetic field sensors of the set by letters A to D.

| | A | B | C | D |
|---|---|---|---|---|
| 0° | x | | | x |
| 90° | x | x | | |
| 180° | | x | x | |
| 270° | | | x | x |

The control circuit 31 requires timing or clock signals for the processing of the information it has read. The timing signals are derived, without additional control means of the magnetic key 1, directly from the magnets 13, 15 providing the locking code information. For this purpose all magnetic field sensors 23, 25 responding to the magnets 13, 15 are connected with an OR-gate 35, the output 37 of which delivers a timing pulse to the control circuit 31 whenever a segment 9 is pushed past the associated selective magnetic field sensors 23 or 25 of the reading device 3.

In the insertion of the magnetic key 1 into the reading device the control circuit 31 counts the timing pulses occurring until the response of the magnetic field sensor 29 and compares the counted number with a given timing pulse number predetermined by the number of segments 9. The output signal at the output 33 is generated only if the counted number conforms with the predetermined number. In this way tampering and defective insertion of the magnetic key, for example in the form of brief drawing back in insertion, can be recognised.

Alternatively, the control circuit 31 can count on the one hand, in the insertion of the magnetic key 1 into the reading device 3, the number of timing pulses occurring until the insertion indicator 29 responds and on the other hand the timing pulses occurring in the subsequent withdrawal of the magnetic key 1. The control circuit 31 compares these two counted timing pulse numbers with one another. With correct insertion and withdrawal of the magnetic key these timing pulse numbers must be in conformity. In this case the control signal of the output 33 is not already delivered on insertion, but only on withdrawal of the magnetic key.

Further security against tampering is obtained if the control circuit 31 detects the locking code information not only in the insertion of the magnetic key 1 into the reading device 3, but also in withdrawal from the reading device. The control signal at the output 33 is generated only when the locking code information read in the insertion and the locking code information read in withdrawal and then reversed in time are in conformity with the predetermined locking code information of the locking system.

Especially when the locking system is used in motor vehicles it should be ensured that the locking system has a minimal power consumption. In order to keep the power consumption low at least when the reading device 3 is merely in reading readiness mode of operation, it is provided that the magnetic field sensors 23, 25 and 29 are connected to a working voltage source 41 through a controllable switch 39 formed for example by a transistor. The control circuit 31 is connected through a series resistor 43 to the control input of the switch 39, for example the base of the transistor, and periodically alternately opens and closes the switch 39 in reading readiness condition. The ratio of the closed switch time interval to the opened switch time interval determines the average power consumption of the reading device 3, which is considerably reduced in time average compared with a continuously switched-on manner of operation of the reading device. The closed switch time interval can be very short and is determined essentially by the response time of the magnetic field sensors 23, 25, 29 in the passing movement of the magnets. The opened switch time interval is determined essentially by the maximum speed at which the magnetic key 1 can be inserted in the reading device 3. It must be ensured that even at maximum speed of displacement at least the first magnet to be read by the reading device 3 cannot be pushed through the response region of the associated magnetic field sensor during the opened switch time period. The first magnet to be read can be made longer in the axial direction of the shank 5 than are the other magnets, in order to prolong the opened switch time period. The control circuit 31 responds to the first magnet read and thereupon closes the switch 39 constantly during a time period adequate for the subsequent reading operation. The opening of the switch 39 after conclusion of the reading operation can be determined by the insertion indicator 29, the control signal at the output 33 or by a time member determining a maximum reading time duration.

While specific embodiments of the invention have been shown and described in detail to illustrate the application of the inventive principles, it will be understood that the invention may be embodied otherwise without departing from such principles.

I claim:

1. A locking system comprising:

(a) a magnetic key having a plurality of magnets, arranged one behind another in a pattern of a plurality of rows lying parallel side by side to form a locking code of the magnetic key, at least the magnets of the pattern positions of each row which are immediately adjacent in the row direction being polarised in opposite directions, (b) a reading device into which the magnetic key is insertable in the direction of the rows of its magnets and which comprises magnetic field sensors for the serial reading of the locking code formed by the magnets, each row of magnets being read by a pair of two magnetic field sensors, a first magnetic field sensor of each pair responding selectively to magnetic fields of a predetermined polarity and a second magnetic field sensor of each pair responding selectively to magnetic fields with a polarity opposite to the predetermined polarity, and (c) a control circuit which compares the information of the read locking code with the information of a predetermined locking code and generates a control signal in dependence upon the conformity or difference of the locking codes.

2. The locking system according to claim 1, wherein the pattern positions of all magnet rows of the magnetic key lie transversely of the row direction in planes parallel to one another and extending transversely of the row direction, and in each plane at least one magnet is arranged, and wherein in each pattern plane there are arranged either exclusively magnets of the predetermined polarity or exclusively magnets of the opposite polarity.

3. The locking system according to claim 2, wherein in the row direction pattern planes with magnets of the predetermined polarity and pattern planes with magnets of the opposite polarity follow one another in alternation.

4. The locking system according to claim 2, wherein the first magnetic field sensors on the one hand the the second magnetic field sensors on the other are arranged in planes parallel to one another and to the pattern planes and wherein the outputs of the first and second magnetic field sensors are OR-linked with one another for the generation of a timing pulse signal of the control circuit.

5. The locking system according to claim 4, wherein the reading device comprises an insertion indicator delivering an indicator signal when the magnetic key is fully inserted, and wherein the control circuit comprises a counting means for counting timing pulses and generates the control signal when a predetermined number of timing pulses has been counted by the time the indicator signal occurs.

6. The locking system according to claim 5, wherein the counting means on the one hand counts the number of the timing pulses produced in the insertion of the magnetic key into the reading device until the indicator signal occurs and on the other hand the number of timing pulses produced in the withdrawal of the magnetic key from the reading device after occurrence of the indicator signal, and wherein the control circuit generates the control signal if the number of timing pulses counted in the withdrawal of the magnetic key is equal to the number counted in the insertion.

7. The locking system according to claim 1, wherein the reading device comprises an insertion indicator which delivers an indicator signal when the magnetic key is fully inserted and wherein the control circuit compares the information of the predetermined locking code both with the information of the locking code read in the insertion of the magnetic key into the reading device until the indicator signal occurs and with the information of a locking code being read and time-inverted after the occurrence of the indicator signal in the withdrawal of the magnetic key from the reading device and generates the control signal in dependence upon the conformity or the difference of the three locking codes.

8. The locking system according to claim 1, wherein the reading device is connected through a switch controllable by the control circuit to a working voltage source, and wherein the control circuit, in an electric power saving readiness condition of the reading device, periodically opens and closes the switch, and upon the first magnet detected by the reading device in the insertion of the magnetic key holds the switch constantly closed at least for the duration of the reading of the locking code information.

9. The locking system according to claim 8, wherein the control circuit holds the switch constantly closed for a predetermined time period after the commencement of the reading of the locking code information.

* * * * *